United States Patent [19]

Lockwood

[11] Patent Number: 4,852,833

[45] Date of Patent: Aug. 1, 1989

[54] PAINT BRUSH HOLDER

[76] Inventor: Larry E. Lockwood, 341 Wilson Drive, Unit 4, Milton, Ontario, Canada, L9T 3Y9

[21] Appl. No.: 221,655

[22] Filed: Jul. 20, 1988

[51] Int. Cl.[4] ..... A46B 17/02

[52] U.S. Cl. ..... 248/110; 206/209; 206/362; 211/66

[58] Field of Search ..... 248/110, 111, 112, 113; 211/65, 66; 206/209, 361, 362

[56] References Cited

U.S. PATENT DOCUMENTS

| | | | |
|---|---|---|---|
| 288,692 | 11/1883 | Cowley et al. | 211/65 |
| 711,410 | 10/1902 | Means | 248/97 X |
| 778,272 | 12/1904 | Roop . | |
| 1,461,618 | 7/1923 | Hopkins | 206/209 |
| 1,471,712 | 10/1923 | Sohnle | 248/110 X |
| 1,754,366 | 4/1930 | Lissy | 248/113 |
| 2,278,650 | 4/1942 | Drinkwater | 211/65 |
| 2,355,549 | 6/1944 | Myers . | |
| 2,466,850 | 4/1949 | Hoffman et al. . | |
| 2,566,650 | 9/1951 | Anderson | 211/65 |
| 2,578,233 | 12/1951 | Entsminger . | |
| 2,744,635 | 5/1956 | Hiss | 248/113 X |
| 2,936,878 | 5/1960 | Claude | 206/209 |
| 2,945,251 | 7/1960 | Eichner | 248/113 X |
| 2,952,364 | 9/1960 | Jacobson . | |
| 3,156,364 | 11/1964 | Wolcott | 211/65 |
| 3,185,311 | 5/1965 | Roberts et al. . | |
| 3,527,341 | 9/1970 | Peebles | 206/209 |

FOREIGN PATENT DOCUMENTS

| | | | |
|---|---|---|---|
| 494761 | 7/1953 | Canada | 206/209 |
| 13437 | of 1913 | United Kingdom | 211/65 |
| 826430 | 1/1960 | United Kingdom | 206/209 |
| 2116028 | 9/1983 | United Kingdom | 206/361 |

*Primary Examiner*—Alvin C. Chin-Shue
*Assistant Examiner*—David L. Talbott
*Attorney, Agent, or Firm*—Sim & McBurney

[57] ABSTRACT

A paint brush holder for placing in a paint bucket to be wholly enclosed therein comprises an open framework cylindrical structure shaped to conform to the shape of the paint bucket. A plurality of radially-directed prongs provide supports for the paint brushes and are provided at two different heights. A transverse bar functions as a lifting handle and a scraper bar for removal of excess paint from brushes.

12 Claims, 3 Drawing Sheets

PAINT BRUSH HOLDER

FIELD OF INVENTION

The present invention rleates to paint brush holders, in particular to a unique portable paint brush holder, used in combination with a paint bucket.

BACKGROUND TO THE INVENTION

A variety of paint brush holders has been described in the prior art. A search with respect to the device disclosed herein has revealed U.S. Pat. Nos. 778,272, 2,355,549, 2,446,850, 2,578,233, 2,952,364 and 3,185,311.

U.S. Pat. No. 778,272 shows the use of a support for a paint brush in a paint can. U.S. Pat. Nos. 2,355,549 and 2,466,850 show the use of a wiper bars for excess paint in conjunction with paint cans, and, in the case of U.S. Pat. No. 2,466,850, in combination with a paint brush holder. U.S. Pat. No. 2,578,233 shows a combined paint can handle and brush holder arrangement. U.S. Pat. No. 2,952,364 shows a removable insert for supporting a plurality of brushes inserted in a paint can. U.S. Pat. No. 3,185,311 shows an arrangement for holding brushes of different sizes in a paint can.

None of these prior art structures discloses or suggests the unique paint brush holder of this invention, as will be apparent from the discussion below.

SUMMARY OF THE INVENTION

In accordance with the present invention, there is provided a paint brush support for removable insertion into a container such as a paint bucket, which comprises frame means shaped to conform to the shape of the retainer of the enclosure and dimensioned to be located within the enclosure. The frame means comprises horizontal frame members definng the upper and lower extremities respectively of the frame means and vertical frame members extending between and joined to said upper and lower extremity frame members. The frame means further comprises a further horizontal frame member connected to the vertical frame members spaced downwardly from and generally parallel to the upper extremity frame member.

The paint brush support also includes paint brush holder means in the form of a plurality of elongate prongs extending inwardly from each of the upper extremity horizontal frame member and the further horizontal frame member and dimensioned to be received through openings in paint brush handles to support paint brushes thereby in a substantially vertical orientation.

Transverse bar means extends between and is joined to opposite sides of the upper extremity horizontal member to act as a handle for removal from and insertion in the enclosure of the paint brush support and to act, when in the enclosure, as a scraping bar for removal of excess paint from a brush.

The paint brush support of this invention differs from the prior art discussed above in its unique combination of features, as described in more detail below. The device of the invention enables a plurality of paint brushes to be supported in a container while providing a dual purposes transverse bar.

The frame means and the container generally are of substantially cylindrical shape and may taper slightly and correspondingly downwardly. In this arrangement, the transverse bar means extends substantially diametrically with respect to the upper extremity frame member.

The horizontal frame members usually are provided in the form of steel bands while the vertical frame members usually are provided in the form of elongate steel strips, although metal in other geometrical configurations, such as wire, and a suitable plastic material of any desired configuration may be used, if desired, thereby providing an open latticework structure. The frame is of generally unitary construction, with the frame elements being jointed together by any suitable mechanism consistent with the material of construction, such as welding or molding.

In one preferred embodiment, the frame means is provided with a vertical dimension which permits a top closure or lid to be placed on the container or paint bucket while paint brushes are mounted on the elongate prongs. In this way, paint brushes may be conveniently supported in a closed container.

The paint brush supporting prongs, which usually are of the same length, preferably extend radially inwardly a distance sufficient to permit a plurality of paint brushes to be supported thereby. In this way, a large number of paint brushes may be stored within the container.

The prongs preferably are arranged substantially equally circumferentially spaced on the upper extremity horizontal frame member and the further horizontal frame member. In one embodiment, as illustrated in the drawings discussed below, there are three such prongs extending radially inwardly from the upper extremity horizontal frame member in one half or the periphery thereof and three such prongs extending radially inwardly from the further horizontal frame member in the half of the periphery thereof corresponding to the other half of the periphery of the upper extremity horizontal frame member.

For ease of construction, each of the prongs preferably is identically shaped and includes an integral portion thereof extending between the upper extremity horizontal member and the further horizontal member. The arrangement increases structural strength and provides a ready means of attachment of the prongs to the frame members. Each of the prongs usually has an upwardly-sloping portion at the radially-inner extremity thereof, to inhibit brushes from accidentally becoming dislodged from the prongs.

DESCRIPTION OF PREFERRED EMBODIMENT

Figure 1:
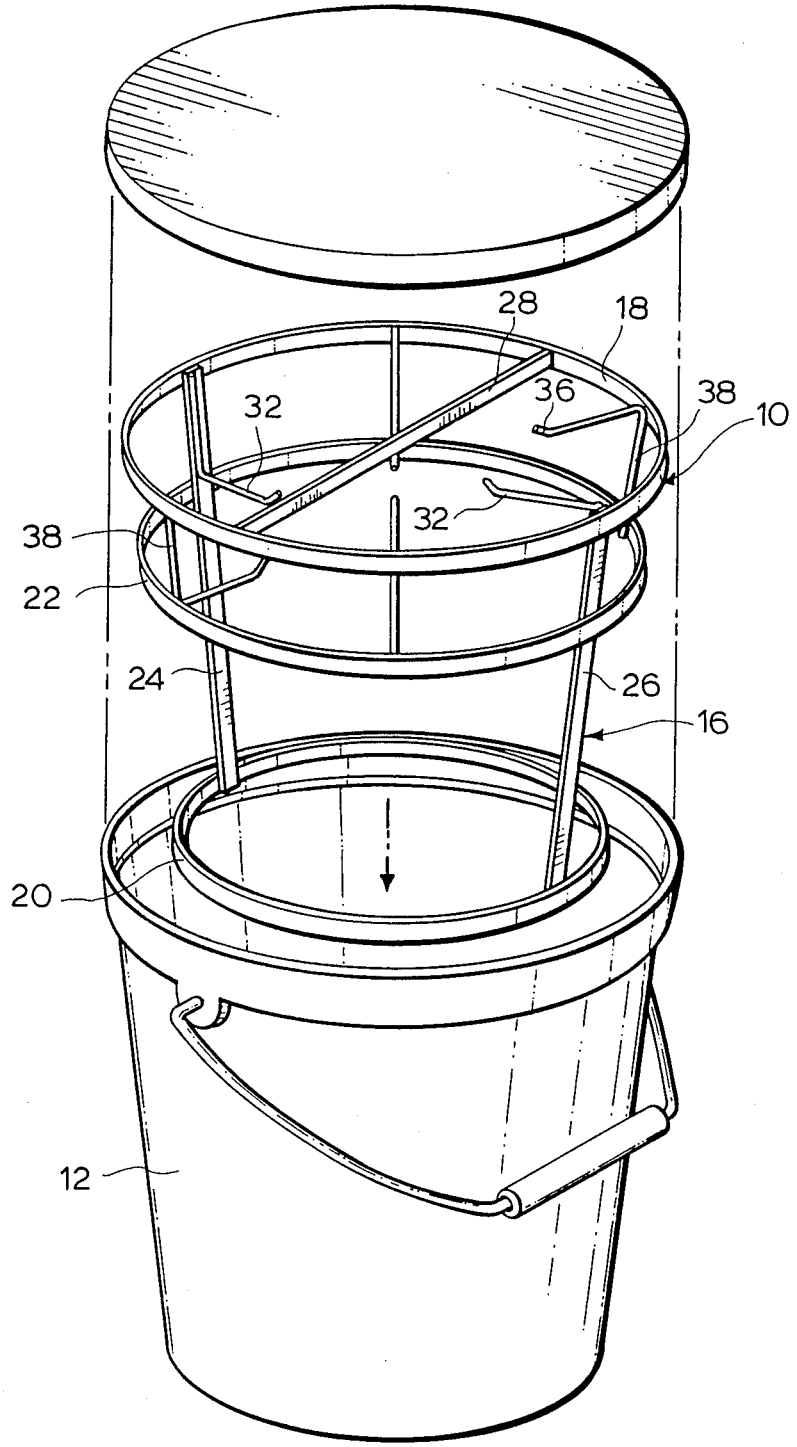
FIG. 1 is a perspective view of the combination of a paint bucket and a paint brush support device constructed in accordance with a preferred embodiment of the invention.

Referring to the drawings, a paint brush holder device 10 according to one embodiment of the invention is received in a paint bucket 12 to be enclosed therein by a cover or lid 14. The paint brush 12 and paint brush holder 10 have a complementary downwardly tapering structure.

The paint brush holder 10 has a frame 16 comprising an upper band 18, a lower band 20, an intermediate band 22 spaced downwardly a short distance from the upper band 18, and a pair of elongate bars 24, 26 extend between the upper and lower bands 18, 20 and joined to the bands 18, 20, 22. In the illustrated embodiment, the frame elements are formed of steel and are joined by welding.

Figure 3:
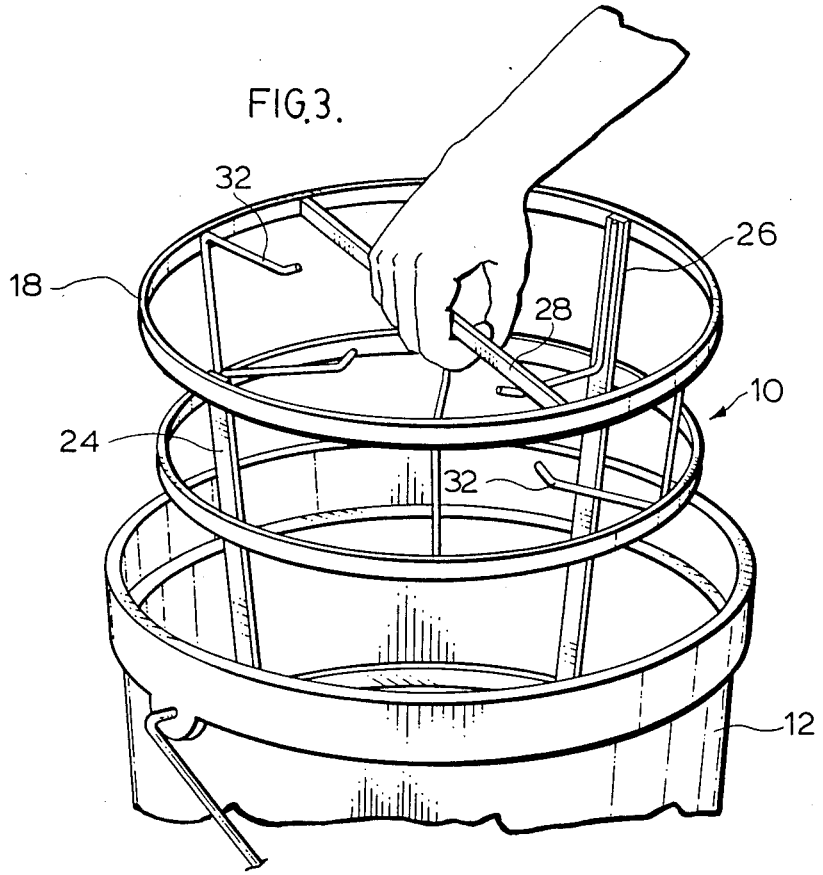
FIG. 3 is a perspesctive view of the combination of FIG. 1, illustrating removal of the paint brush holder from the bucket.
Figure 4:
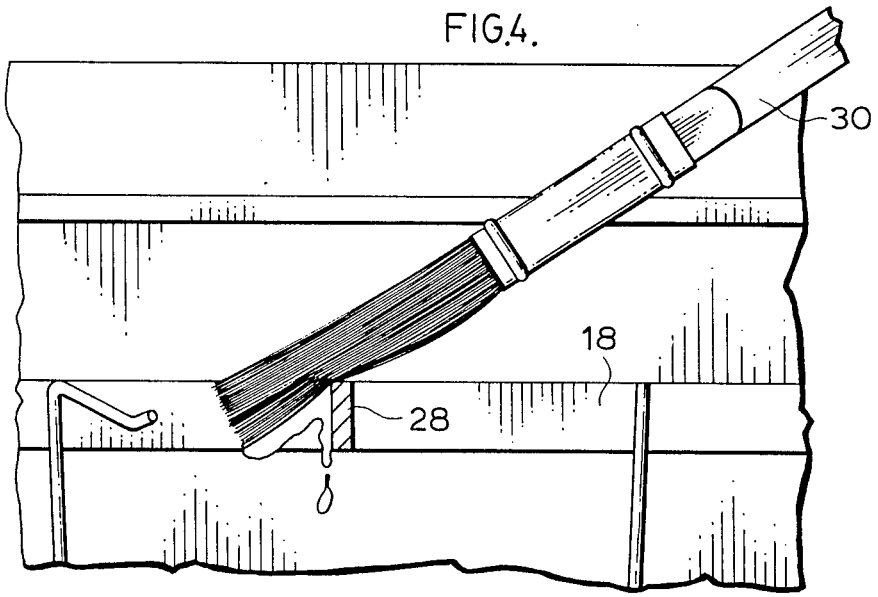
FIG. 4 is a detail view of the combination of FIG. 1, illustrating use of the handle bar as an excess paint wiping bar.

A transverse bar 28 extends diametrically to be joined to the upper band 18 at a location spaced 90° from the join of the elongate bars 24, 26. In addition to providing structural strength to the frame 12, the transverse bar 28 also serves as a handle for removal from an insertion into the paint bucket 12 of the paint brush holder 10, as can be seen from FIG. 3 and as a wiping bar for removal of excess paint from a paint brush 30 when the device 10 is positioned in the bucket 12, as seen in FIG. 4.

Figure 2:
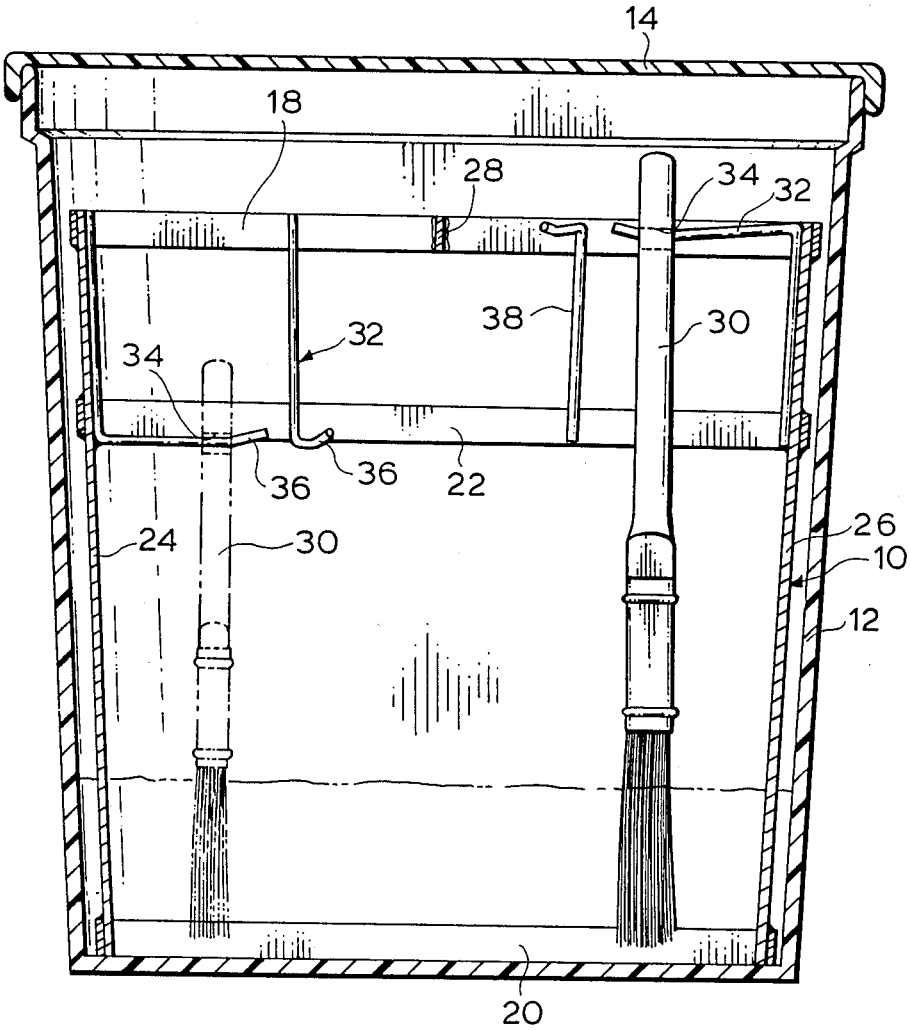
FIG. 2 is a sectional view of the paint bucket and support device combination.

A plurality of prongs 32 is provided extending radially inwardly of the frame 16. The prongs 32 include a first set which extend inwardly from the upper band 18 and a further set which extend inwardly from the intermediate band 22. This arrangement permits brushes 30 of different lengths to be accommodated in the bucket without dipping into any paint in the bucket 12, as seen in FIG. 2.

The prongs 32 have an elongate extension which permits a plurality of paint brushes 30 to be mounted thereon by extension through openings 34 that are normally found in the handle of the paint brushes 30 and include an upwardly-extending end portion 36 to inhibit accidental dislodgement of the brush 30 from the prongs 32.

Each prong 32 is of the same size and shape and includes an upright portion 38 which extends between the upper band 18 and the intermediate band 22. The prongs 32 are arranged substantially equally circumferentially spaced, thence extending upwardly from the upper band 18 and thence extending inwardly from the intermediate band 22.

The frame 16 is dimensioned to have a height such that it can be received wholly within the bucket 12 and, when paint brushes are received on the prongs 32, the paint brushes 30 are accommodated wholly within the bucket 12, so that a top closure 14 can be fitted on the bucket 12, to enable ready transportation of bucket 12 and holder 10 with brushes 30 thereon without spilling paint from the bucket 12.

The brush holder device 10 is illustrated in a form suitable for use by a professional painter with a large bucket 12. However, the principles of the present invention may be employed to construct a brush holder, for example, of smaller dimensions for domestic use.

SUMMARY OF DISCLOSURE

In summary of this disclosure, the present invention provides a novel paint brush holder structure which has many features and benefits not seen in the prior art. Modifications are possible within the scope of this invention.

What I claim is:

1. A paint brush support for removal insertion into a container, which comprises:

frame means of a generally cylindrical shape and shaped to conform to the shape of the interior of the container and dimensioned to be located within said enclosure, said frame means comprising circular horizontal frame members defining the upper and lower extremities respectively of said frame means and vertical frame members extending between and joined to said upper and lower extremity frame members, said frame means further comprising a further circular horizontal frame member connected to said vertical frame member spaced downwardly from and generally parallel to said upper extremity frame member, paint brush holder means in the form of a plurality of elongate prongs extending inwardly from each of said upper extremity horizontal frame member and said further horizontal frame member and dimensioned to be received through openings in paint brush handles to support paint brushes thereby in a substantially vertical orientation, and transverse bar means extending diametrically between and joined to opposite sides of said upper extremity horizontal member to act both as a handle for removal from and insertion in said enclosure of said paint brush support and, when in said enclosure, as a scraping bar for removal of excess paint from a brush.

2. The device of claim 1 wherein said frame means and said container are slightly and correspondingly tapered downwardly.

3. The device of claim 1 wherein said transverse bar means extends substantially diametrically with respect to said upper extremity frame member.

4. The device of claim 3 wherein said horizontal frame members are provided in the form of bands and said vertical frame members are elongate strips.

5. The device of claim 4 wherein said frame means is of unitary construction.

6. The device of claim 1 wherein said frame means has a vertical dimension which permits a top closure to be placed on said container while paint brushes are received on said elongate prongs.

7. The device of claim 1 wherein said prongs extend generally radially inwardly a distance sufficient to permit a plurality of paint brushes to be supported thereby.

8. The device of claim 7 wherein each of said prongs is of the same length.

9. The device of claim 8 wherein said prongs are arranged substantially equally circumferentially spaced.

10. The device of claim 9 wherein there are three such prongs extending radially inwardly from the upper extremity horizontal frame member in one half the periphery thereof and three such prongs extending radially inwardly from the further horizontal frame member in the half of the periphery thereof corresponding to the other half of the periphery of the upper extremity horizontal frame member.

11. The device of claim 10 wherein each of said prong members includes an integral portion thereof extending vertically between said upper extremity horizontal member and said further horizontal member.

12. The device of claim 11 wherein each of said prong members has an upwardly sloping portion at the radially-inner extremity thereof.

* * * * *